United States Patent [19]

Hayasaka

[11] Patent Number: 4,963,109

[45] Date of Patent: Oct. 16, 1990

[54] SHIFTING DEVICE FOR MARINE PROPULSION UNIT

[75] Inventor: Kenichi Hayasaka, Hamamatsu, Japan

[73] Assignee: Sanshin Kogyo Kabushiki Kaisha, Hamamatsu, Japan

[21] Appl. No.: 492,253

[22] Filed: Mar. 9, 1990

Related U.S. Application Data

[63] Continuation of Ser. No. 276,062, Nov. 25, 1988, abandoned.

[30] Foreign Application Priority Data

Nov. 26, 1987 [JP] Japan ..... 62-298807

[51] Int. Cl.[5] ..... B63H 21/21

[52] U.S. Cl. ..... 440/75; 440/86

[58] Field of Search ..... 440/75, 84, 86

[56] References Cited

U.S. PATENT DOCUMENTS 2,663,277 12/1953 Armstrong et al. ..... 440/75

2,887,083 5/1959 Conroy ..... 440/86

*Primary Examiner*—Sherman Basinger

*Attorney, Agent, or Firm*—Ernest A. Beutler

[57] ABSTRACT

A transmission mechanism for a marine outboard drive including a linkage system that interconnects a remotely positioned shift lever to a slidably supported dog clutching element. A detent mechanism is provided in the motion transmitting mechanism for retaining the motion transmitting mechanism in a position corresponding to one of the positions of the dog clutching element.

7 Claims, 6 Drawing Sheets

SHIFTING DEVICE FOR MARINE PROPULSION UNIT

This is a continuation of U.S. Pat. application Ser. No. 276,062, filed Nov. 25, 1988, now abandoned.

BACKGROUND OF THE INVENTION

This invention relates to a shifting device for a marine propulsion unit and more particularly to an improved shifting mechanism for an outboard drive that insures that the components of the shifting mechanism will always be maintained in the appropriate position relative to each other.

Many forms of marine propulsion units employ forward, neutral, reverse transmissions that are actuated by a slidably moveable dog clutching element for driving the propulsion unit in a forward or reverse direction. Most frequently, this type of transmission is positioned the lower unit of an outboard drive and it is common to so position the units in the outboard drive portion of an inboard/outboard drive. Quite frequently, the transmission is actually controlled by a remotely positioned shift lever that is in proximity to the operator's location of Therefore, some form of motion transmitting mechanism must be incorporated between the remotely positioned shift control and the dog clutching element. Of course, the use of such motion transmitting mechanisms can give rise to certain problems.

For example, it is the common practice to employ a detent mechanism in the dog clutching element for retaining it in at least its neutral position. In a similar manner, the shift lever includes normally a detent mechanism for also holding the shift lever in its neutral position. However, the interconnecting linkage and motion transmitting mechanism has no device that tends to maintain it in a preset position and, certain problems can result.

It is, therefore, a principal object of this invention to provide an improved shifting device for a marine propulsion unit.

It is a further object of this invention to provide an improved motion transmitting mechanism for the shifting device of a marine propulsion unit wherein it will be insured that all components are maintained in their proper positions.

It is a still further object of this invention to provide an improved shifting device for a marine propulsion unit that incorporates a detent mechanism in the motion transmitting device between the shift lever and the dog clutching element.

SUMMARY OF THE INVENTION

This invention is adapted to be embodied in a shifting mechanism for an outboard drive that is adapted to be affixed to the transom of a The outboard drive has a selectably engageable transmission which includes a clutching element moveable between an engaged position and a disengaged position. A shift linkage is operatively connected t the dog clutching element for moving the dog clutching element between its positions. The shift linkage includes an input element that is adapted to be connected to a shift operator positioned on the other side of the transom from the outboard drive. In accordance with the invention, detent means act directly on the shift linkage for yieldably retaining the shift linkage in a position corresponding to one of the positions of the dog clutching element.

DETAILED DESCRIPTION OF THE PREFERRED EMBODIMENTS OF THE INVENTION

Figure 1:
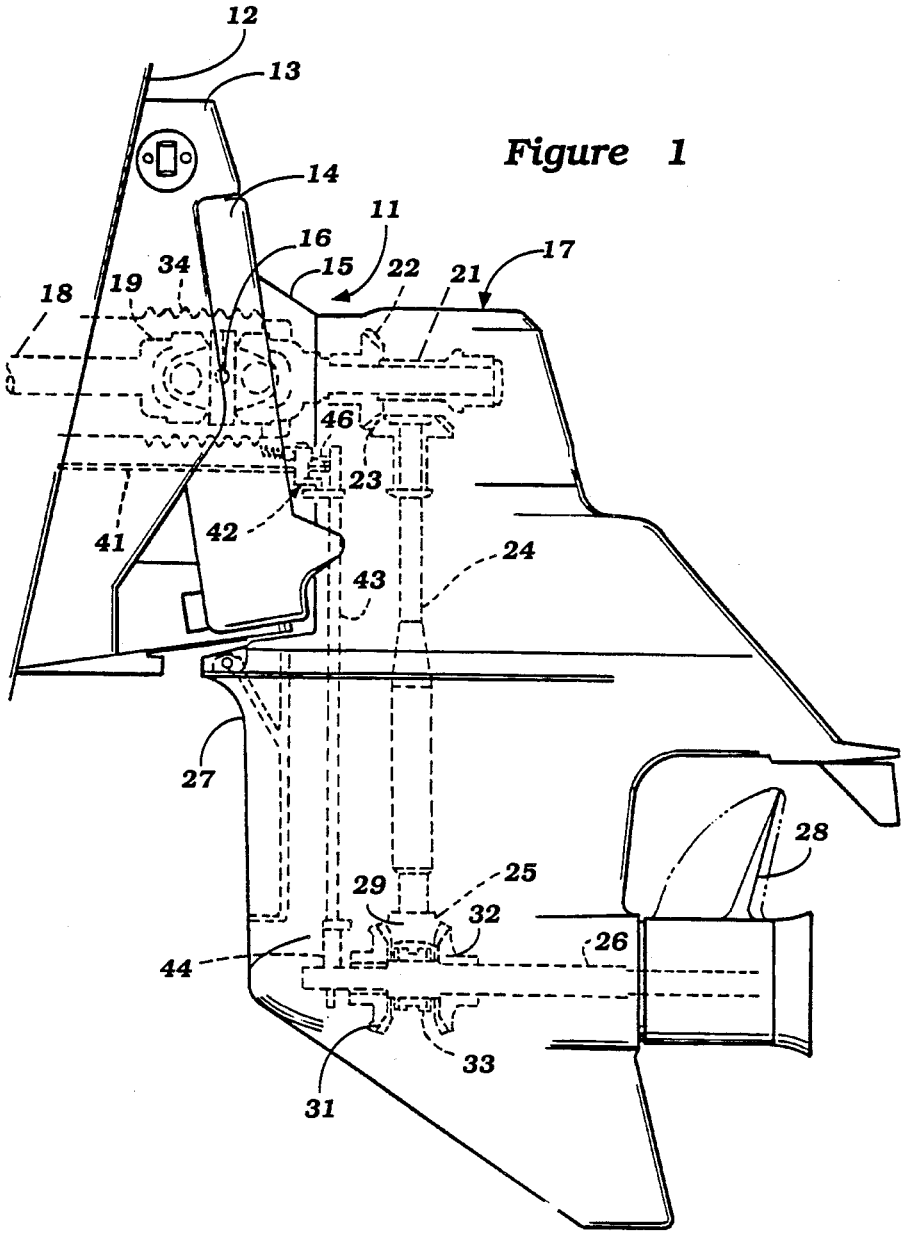
FIG. 1 is a side elevational view of a marine outboard drive constructed in accordance with a first embodiment of the invention.

Referring now in detail to the drawings and initially to the embodiment of FIG. 1 through 4 and primarily to FIG. 1, a marine outboard drive constructed in accordance with an embodiment of the invention is identified generally by the reference numeral 11. The invention is described in conjunction with the outboard drive portion of an inboard/outboard drive but, as has been noted, certain facets of the invention have similar utility in an outboard motor per se or, in fact, have utility in other types of transmissions.

The outboard drive 11 is adapted to be utilized in conjunction with an associated watercraft, the transom of which is identified at 12. A transom plate or gimbal housing 13 of the outboard drive 11 is affixed in a known manner to the transom 12 and supports a gimbal ring 14 for steering movement about a generally vertically extending axis. A housing portion 15 of the outboard drive unit 11 is connected to the gimbal ring 14 for tilting movement about a generally horizontally extending axis defined by a pair of gimbal pins 16 so that the angular position of a main housing 17 of the outboard drive unit may be adjusted to various trim adjusted positions and to a tilted up, out of the water position.

An engine driven output shaft 18 is driven by an inboard position engine (not shown) and extends through a suitable opening in the transom 12. A universal joint connection 19 interconnects the driving shaft 18 to a driven shaft 21 that is journaled within the housing 17 in a known manner. A bevel gear 22 is affixed for rotation with the shaft 21 and is enmeshed with a driven bevel gear 23 that is non rotatable affixed to the upper end of a drive shaft 24. The drive shaft 24 is suitably journaled for rotation about a generally vertically extending axis within the housing 17 in a known manner.

A forward, neutral, reverse transmission, indicated generally by the reference numeral 25, is provided for selectively coupling the drive shaft 24 to a propeller shaft 26 that is journaled in a lower unit 27 of the housing 17. The propeller shaft 26 is journaled in a known manner and is affixed to a propeller 28 for powering the associated watercraft.

The forward, neutral, reverse transmission 25 is generally of a known type and includes a driving bevel gear 29 that is affixed to the lower end of the drive shaft 24. The driving bevel gear 29 is enmeshed with a pair of diametrically opposed driven bevel gears 31 and 32 so that the gears 31 and 32 will rotate in opposite directions as the drive shaft 24 rotates. The transmission 25 is completed by means of a dog clutching element 33 that has a splined connection to the propeller shaft 26 and which is axially moveable therealong for engagement of dog clutching teeth carried by it with corresponding dog clutching teeth of the driven gears 31 and 32 for selectively coupling either of these gears for rotation with the propeller shaft 26 for driving it in selected forward and reversed directions. In addition, the dog clutching sleeve 33 has a neutral position in which neither of the gears 31 or 32 is coupled to the shaft 26 and hence the drive shaft 24 can rotate without driving the propeller shaft 26. A detent mechanism (not shown) may be provided for yieldably retaining the dog clutching element 33 in any or all of its positions. In a similar manner and as is normal practice, a detent mechanism may also be provided in the shifting lever for retaining it in at least its neutral position.

There is provided a flexible boot 34 that encircles the universal joint 19 and provides sealing between the transom 12 and the outboard drive unit.

The foregoing construction may be considered to be conventional and it is only the shifting mechanism that is employed for operating the dog clutching element 33 and the detent device associated with which differs from the prior art. For that reason, further description of the conventional details of the outboard drive 11 are not believed to be necessary to understand the invention and reference may be had to any of the conventional outboard drive constructions for details which form no part of the invention.

As noted, the invention relates primarily to the mechanism for transmitting motion between the operator controlled shift lever (not shown) that is moveable between an forward, neutral and reverse position and which operates a shift rod 41 and the dog clutching element 33 and the detent mechanism associated with it. A motion transmitting mechanism, indicated generally by the reference numeral 42 is provided to operate a shift shaft 43 which, in turn, operates a cam mechanism contained within the lower unit and identified generally at 44 for moving the dog clutching element 33. The cam mechanism 44 may be considered to be conventional and it is the transmitting mechanism 42 which embodies the invention.

It has been discovered that conventional shift mechanisms do not achieve the desired rate of movement and relationship of movement of the dog clutching sleeve 33 relative to the shifting lever. That is, it has been found that more effective shifts can be accomplished if a transmitting mechanism 42 is provided that will achieve first initial rapid movement of the dog clutching sleeve 33 upon movement of the shift lever from its neutral position to either its forward or reverse positions and then a more gradual yet more forceful movement.

Figure 2:
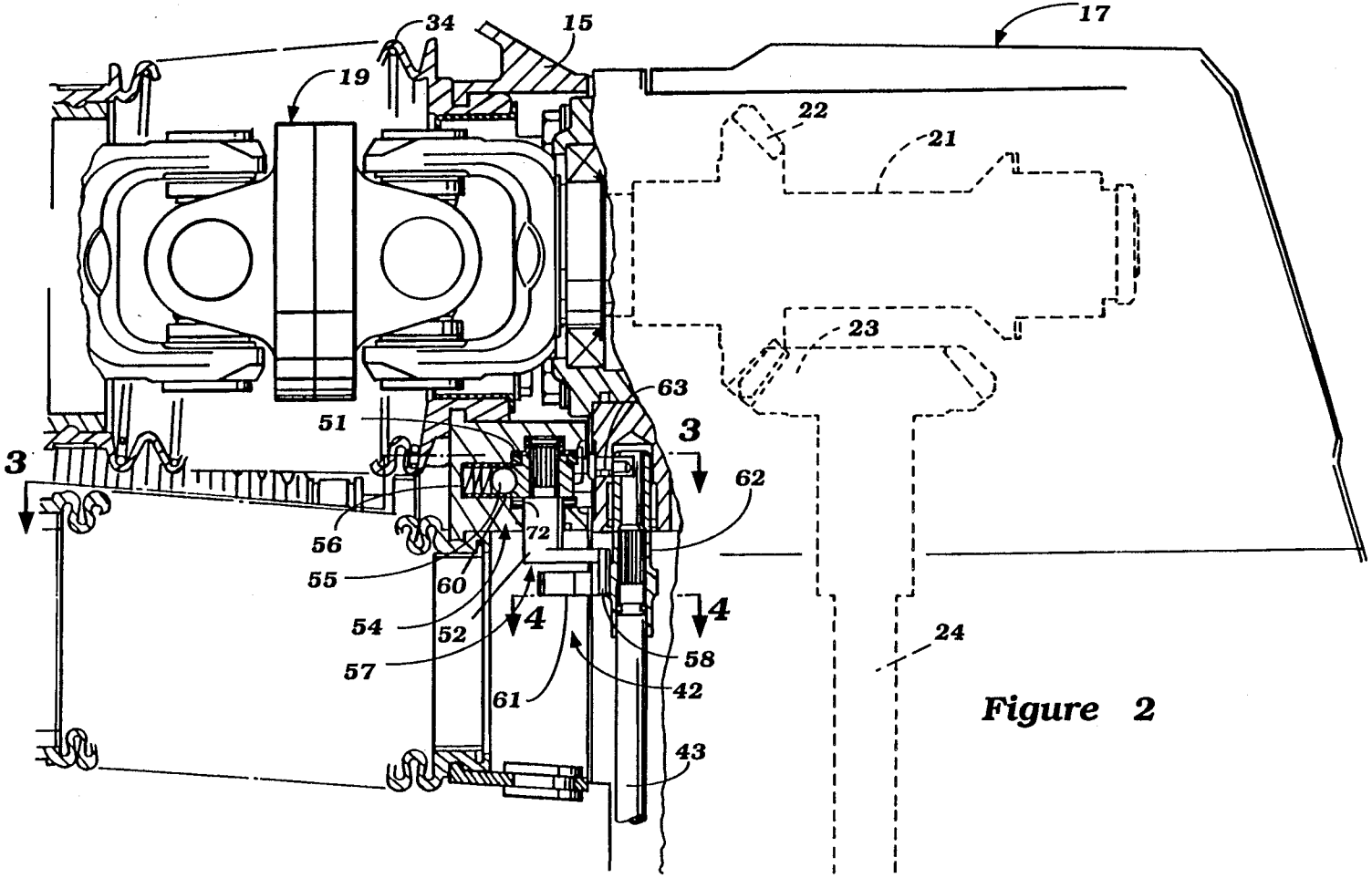
FIG. 2 is an enlarged view of the upper portion of the outboard drive, with a portion broken away so as to show in more detail the shifting mechanism.
Figure 3:
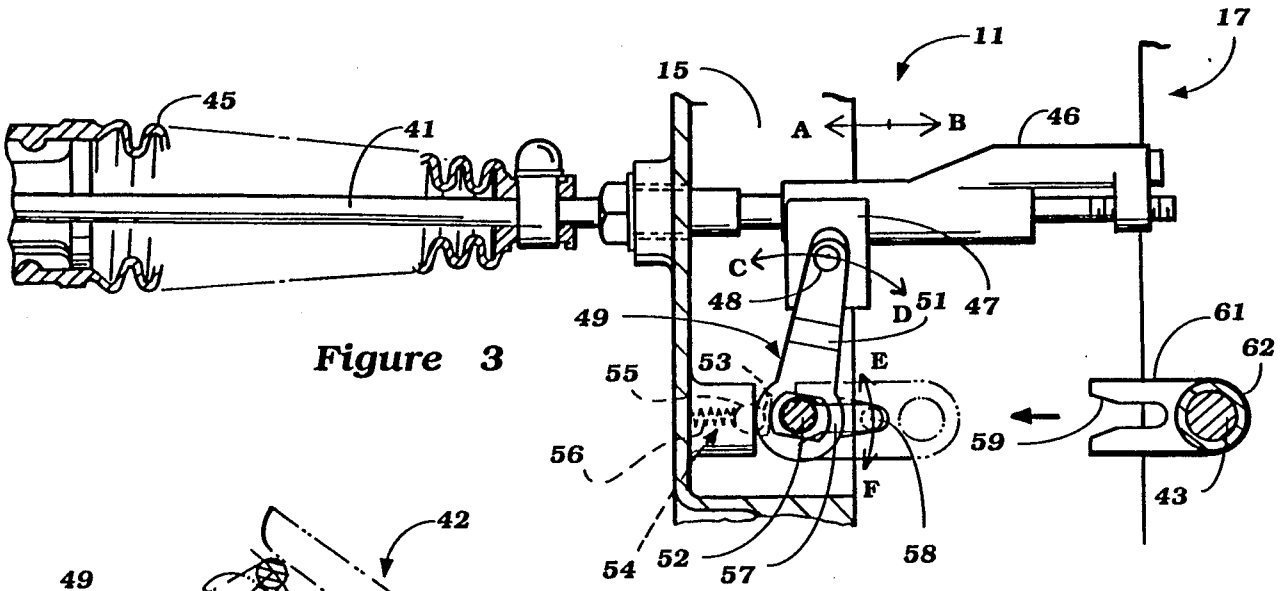
FIG. 3 is an partially exploded cross-sectional view taken along the line 3—3 of FIG. 2 and shows further details of the shifting mechanism.
Figure 4:
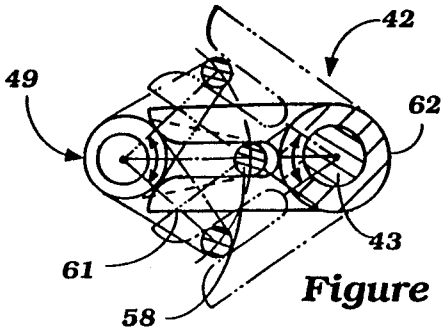
FIG. 4 is a still further enlarged top plan view of the shifting mechanism showing its various positions and the ratio of force transmission.

Referring now primarily to FIGS. 2 through 4, the shift actuating rod 41 is encircled within a flexible bellows 45 to effect sealing and is connected at its rearward end to an operating member 46. The operating has affixed to it, a yoke 47 that is formed with a slot that is engaged by a pin or cam member 48 carried on a first lever 49. The lever 49 has a spline connection 50 to a shaft 52 having an arm portion 51. The first shaft 52 is journaled suitably in the housing 15. The lever 49 has a detent receptacle 53 that is normally engaged by a detent mechanism, indicated generally by the reference numeral 54 and comprised of a ball 55 and biasing spring 56 for retaining the lever 49 in the neutral position. The detent mechanism and specificlally the ball 55 and spring 56 are supported in a sleeve 60 fixed in the housing assembly 17 in a suitable manner. The lever 49 may rotate either in the forward direction C or direction D in response to reciprocation of the shift rod 41 in the directions A and B respectively.

The lever 49 is axially affixed to the shaft 52 between an antifriction bushing 71 and a snap ring 72 that is, in a suitable manner, affixed to the shaft 52. In this way, the lever 49 and associated detent mechanism serve to cooperate with the shaft 52 so as to hold the shaft 52 in the neutral position. If desired, further detent recesses may be formed in the lever 49 for retaining it in the forward and reverse positions also.

The detent mechanism 54 is particularly effective in insuring that all of the components of the shift control will be in the correct position with each other. This is particularly important since it is readily obvious that the shift control lever, Which is not shown, is disposed at a substantial distance from the dog clutching element 33. Thus, the detents in the shift lever and dog clutching element 33 are, themselves, not sufficient to maintain the entire mechanism in its desired relationship, perticularly considering that the parts must have relative to each other due to the steering and tilt and trim movement of the outboard drive 11.

The shaft 50 is formed with a second lever 57 that has a pin 58 that is adapted to be received in a slot 59 formed in a third lever 61 which third lever has a hub portion 62 that is affixed by a spline connection to the upper end of the shift rod 43. A lock screw 63 axially fixes the lever 61 to the shift rod 43.

When the lever 49 swings in the direction C, the lever 57 will swing in the direction E, while when the lever 49 swings in the direction D, the lever 57 will swing in the direction F. It should be noted that the distance between the pivot pin 48 and the supporting shaft 52 is substantially greater than the distance between the pivot pin 58 and the shaft 52. As a result, a given angular movement of the pin 48 will be accompanied by a substantially smaller angular movement of the shaft 58. The geometry is such, as aforenoted, that the reciprocation of the shift rod 41 will cause initially rapid angular movement of the third lever 58 and shift rod 43. However, as the device moves over center, the geometry of the pin and slot connections will cause a smaller degree of angular movement. Hence the final shifting action of the shift lever 43 will be smaller but with a greater force. As a result, the shifting can be achieved quite effectively and without a great deal of chattering or noise.

Figure 5:
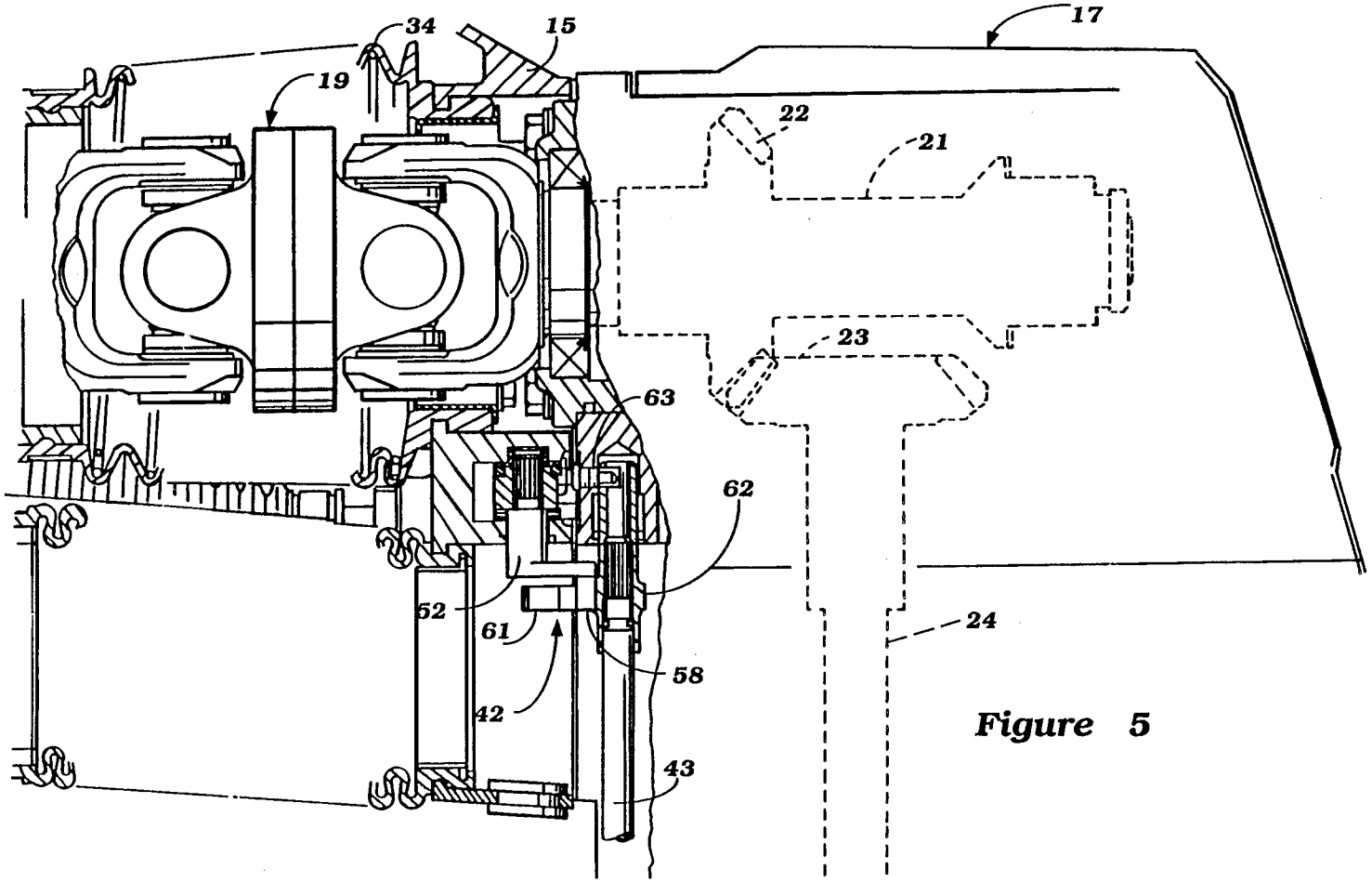
FIG. 5 is an enlarged view, in part similar to FIG. 2, showing another embodiment of the invention.
Figure 6:
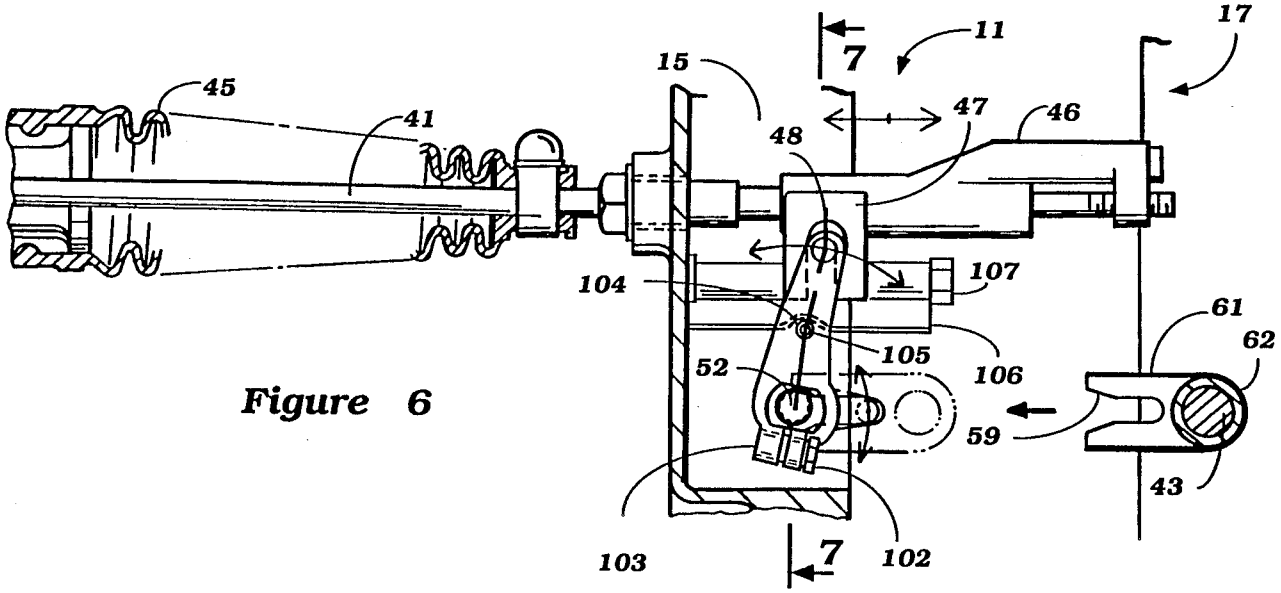
FIG. 6 is a top plan view, in part similar to FIG. 3, showing the construction, of this embodiment of the invention.
Figure 7:
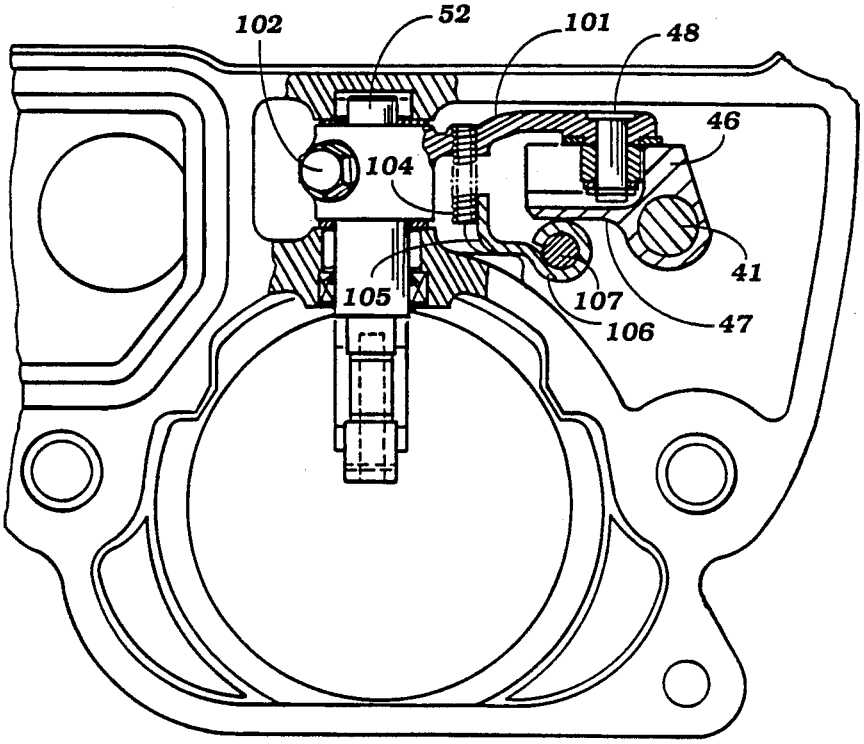
FIG. 7 is a cross-sectional view taken along the line 7—7 and shows the detent mechanism of this embodiment.

FIGS. 5 through 7 show another embodiment of the invention which is generally similar to the embodiment of the FIGS. 1 through 4. Because of this general similarity, components which are the same or substantially the same as the preceding embodiment have been identified by the same reference numeral and will be described again only insofar as is necessary to understand the construction and operation of this embodiment. Basically, this embodiment differs from the previously described embodiment only in the construction of the lever mechanism and the detent which cooperates with it.

In this embodiment, the pin 48 is affixed within a lever 101 which lever is maintained on the shaft 52 by means of a clamping bolt 102 that extends through a split hub 103 of the lever 101. The lever 101 has a coil spring 104 that depends between the shaft 51 and the pin 48 and which acts as a detent member in engagement with a detent slot 105 formed in a plate 106 that is affixed in a suitable manner to the housing 17, as by a bolt 107. During shifting movement, the spring 104 will be camed out of the recess 105 but will yieldably restrain the mechanism in its neutral position. As with the previously described embodiment, it would be possible to add further detent recesses to this embodiment in order to yieldably restrain the lever 101 in other transmission positions than neutral.

It should be readily apparent from the foregoing description that two embodiments of the invention have been illustrated and described, each of which provides an effective detent mechanism for the shifting linkage of a marine outboard transmission. Although two embodiments of the invention have been described and others mentions, still other changes and modifications may be made without departing from the spirit and scope of the invention, as defined by the appended claims.

I claim:

1. In a shifting mechanism for an outboard drive adapted to be affixed to the transom of a watercraft, said outboard drive having a selectably engageable transmission including a clutch member moveable between an engaged position and a disengaged position, a shift operator member, and shift linkage having an intermediate element operably connected to said shift operator member by a first motion transmitting means including an input element for transmitting motion of said shift operator member into movement of said input element and said intermediate element, second motion transmitting means including an output element operably connected to said intermediate element for transmitting movement of said intermediate element into movement of said clutch member, each of said motion transmitting means being effective to translate reciprocation of said shift operator member into rotation of an operably connected element, the improvement comprising detent means acting directly on one of said elements for yieldable retaining said shift linkage in a position corresponding to one of the positions of said clutch member independent of said operator member and said clutch member.

2. In a shifting mechanism as set forth in claim 1 wherein the detent means comprises a ball and socket.

3. In a shifting mechanism as set forth in claim 1 wherein the detent means comprises an axially deflectable spring and a cooperating recess.

4. In a shifting mechanism as set forth in claim 1 wherein at least one of the motion transmitting means effects more rapid movement of said clutch member from its disengaged position to its engaged position during initial movement of said shift operator member and slower movement of said clutch member to its drive position upon the completion of movement of said shift operator member.

5. In a shifting mechanism as set forth in claim 4 wherein the input element of the first motion transmitting means comprises a pivotally supported lever and the detent mechanism operates on said lever.

6. In a shifting mechanism as set forth in claim 5 wherein the detent means comprises a ball and socket.

7. In a shifting mechanism as set forth in claim 5 wherein the detent means comprises an axially deflectable spring and a cooperating recess.

* * * * *